US007040261B2

(12) United States Patent
Granacher et al.

(10) Patent No.: US 7,040,261 B2
(45) Date of Patent: May 9, 2006

(54) TEMPERATURE-CONTROLLED FAN DELAYED SHUT-OFF

(75) Inventors: Thomas Granacher, Schaan (LI); Franz Büchel, Ruggell (LI); Ulrich Schiestl, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 204 days.

(21) Appl. No.: 10/738,324

(22) Filed: Dec. 17, 2003

(65) Prior Publication Data

US 2005/0224024 A1 Oct. 13, 2005

(30) Foreign Application Priority Data

Dec. 19, 2002 (DE) ..... 102 59 775

(51) Int. Cl.
*F02B 71/00* (2006.01)

(52) U.S. Cl. ..... 123/46 SC; 227/10

(58) Field of Classification Search ..... 123/46 R, 123/46 SC, 46 H; 227/10, 130
See application file for complete search history.

(56) References Cited

U.S. PATENT DOCUMENTS 5,713,313 A 2/1998 Berry
6,053,132 A 4/2000 Evans
6,311,887 B1 * 11/2001 Walter ..... 123/46 SC

FOREIGN PATENT DOCUMENTS

DE 4437796 3/1996
EP 0316468 3/1992

* cited by examiner

*Primary Examiner*—Noah P. Kamen
(74) *Attorney, Agent, or Firm*—Abelman, Frayne & Schwab

(57) ABSTRACT

The invention relates to a combustion driven working tool having a combustion chamber (2), a piston (8) guided in a cylinder (5), an ignition system for igniting a fuel supplied to the combustion chamber (2) for driving the piston (8) and a fan (7) at least for ventilating the combustion chamber (2). The running time and/or the speed of the fan (7) can be set as a factor of a measured temperature to realize a combustion driven working tool where an optimal ignition behavior can be set under changing working conditions, in particular under conditions of changing external temperature. A combustion chamber temperature is measured by a first temperature sensor (3) arranged on the combustion chamber (2) and supplied to a control unit (9), which calculates the cooling time and/or the speed for the fan (7) as a factor of the measured combustion chamber temperature and supplies these values to the motor (4). A second temperature sensor (12) is utilized for measuring the external temperature for the calculation of the cooling time or the speed of the fan (7).

4 Claims, 2 Drawing Sheets

TEMPERATURE-CONTROLLED FAN DELAYED SHUT-OFF

BACKGROUND OF THE INVENTION

The invention relates to an internal combustion driven working tool, in particular a setting tool for fastening elements, having a combustion chamber, a piston guided in a cylinder, an ignition system for igniting a fuel supplied to the combustion chamber for driving the piston and a fan at least for ventilating the combustion chamber, wherein the running time and speed of the fan can be set as a factor of a measured temperature.

Internal combustion driven working tools are used for driving bolts or nails into substrates. These working tools have a combustion chamber into which a fuel is supplied. The fuel can be a transferred mixture of gases or a liquid gas, which is mixed in the combustion chamber with fresh air. The fuel can, however, also be provided in powder form as when installing a cartridge. A cylinder, into which a piston is guided, communicates with the combustion chamber. The piston is driven into the cylinder by igniting the fuel present in the combustion chamber. A fastening means, for example a nail, arranged downstream of the piston is driven by the forward propulsion of the piston into a wall or other surface situated in front of the working tool EP 056 990 discloses a combustion powered working tool, wherein a fan is arranged in the combustion chamber and used for mixing a supplied mixture of gases and the supplied fresh air. This fan is controlled independently of the ambient conditions.

U.S. Pat. No. 5,713,313 discloses a combustion powered working tool, wherein one fan is arranged in the combustion chamber and another fan is arranged external to the combustion chamber, which are provided inter alia for cooling the combustion chamber. The fan for cooling is operated for a pre-determined time during or after the ignition process to cool the working tool.

SUMMARY OF THE INVENTION

This type of working tool is used under changing environmental conditions, in particular under extremely fluctuating outside temperatures such as, for example, in winter at temperatures below the freezing point and in summer at temperatures above 30° C. As a result of continuous use of such working tools, the temperature of the working tool is further increased by virtue of the rapidly consecutive ignitions of the fuel such that cooling is required to prevent overheating, especially of the combustion chamber. For effective operation, it is necessary to provide uniform working power for consecutive setting operations. This requires an optimum ignition temperature, which in turn depends on the temperature of the combustion chamber. The temperature of the combustion chamber in its turn depends heavily on the operating temperature of the working tool and on the ambient or outside temperature. In contrast, when supplying liquid fuel gas or mixtures of gases for an optimum fuel mixture, it is necessary to mix the supplied gas and the supplied air sufficiently well. Generally, a fan or a blower is used for this mixing. An optimum mixture of gases can only be mixed if the residual exhaust gases from the previous ignition process have been well purged from the combustion chamber and the oxygen required for optimum ignition is available from the fresh air supply.

At low external temperatures in winter, for example, only a minimum ventilation of the combustion chamber is required for supply of sufficient fresh air for the next ignition; in contrast, in summer an especially long ventilation is required for cooling.

Fans and blowers are known from the aforesaid documents, which are used either for cooling or for mixing of the mixture of gases. A fan that runs for a fixedly set time at lower external temperatures after the ignition process to purge the combustion chamber also cools the combustion chamber. Accordingly, cooling is dependent on the temperature of the fresh air supplied. In an overly cooled combustion chamber, an optimum mixture of gases cannot be formed at the next ignition process and consequently a uniform driving force for driving the fastening elements cannot be produced.

Therefore, the object of the invention is to provide a combustion driven working tool, wherein an optimum ignition behavior can be set under changing working conditions.

The solution relative to the device of the object is provided by an internal combustion driven working tool, in particular a setting tool for fastening elements, having a combustion chamber, a piston guided in a cylinder, an ignition system for igniting a fuel supplied to the combustion chamber for driving the piston and a fan at least for ventilating the combustion chamber, wherein the running time and speed of the fan can be set as a factor of a measured temperature.

The basic concept of the invention is that for an optimum ignition behavior ventilation is necessary particularly for flushing the residual exhaust gas; the duration of the ventilation, however, is dependent in particular on the temperature of the combustion chamber.

Accordingly, the invention envisages setting the running time and/or the speed of the fan depending on a measured temperature. In this fashion, the advantage is provided that the fan runs for a longer time and/or at a faster speed only when a preset temperature is exceeded, as necessary.

At low temperatures, the fan is prevented from excessively cooling the combustion chamber by supplying cold fresh air. When this is done, either the running time alone or the speed of the fan alone can be set. Both the running time and the speed of the fan, however, can also be set.

In an advantageous embodiment of the invention, a combustion chamber temperature is measured using a first temperature sensor arranged on the combustion chamber. The running time or the speed must be set primarily depending on the combustion chamber temperature. Since, for example, even in winter the combustion chamber takes on an increased temperature after frequent ignition processes, it is necessary to cool the combustion chamber.

In an advantageous embodiment of the invention an external temperature is measured using a second temperature sensor. In this fashion it is possible, with an increase of the external temperature, to set the fan for a longer cooling period or to increase the speed of the fan and thus to timely counter overheating of the combustion chamber.

The measured combustion chamber temperature is sent to a control unit, which regulates the cooling period and/or the motor speed of the fan as a factor of the measured combustion chamber temperature and/or the external temperature. By virtue of the capability of setting the time that the fan runs or the r.p.m. at which the fan runs in a pre-defined time unit, cooling can be limited at correspondingly low external temperatures or can be increased at correspondingly higher temperatures. In particular because the speed at which the motor of the fan operates can be set, satisfactory flushing of the residual gases can be achieved in a short time at high speed and, if required, the necessary cooling of the combustion chamber done. Accordingly, by increasing the speed at high combustion chamber temperatures a high setting rate is possible using the working tool.

In a further advantageous embodiment of the invention, the fan is arranged in the combustion chamber. This has the advantage, that utilization of the fan by the direct arrangement in the combustion chamber is very effective and consequently a costly air conduction system is eliminated, which would be needed to conduct the air flow generated by the fan arranged outside of the combustion chamber to the combustion chamber. The arrangement inside the combustion chamber requires a robust fan, which is not impaired in its functionality by the ignition processes.

BRIEF DESCRIPTION OF THE DRAWINGS

An exemplary embodiment of the invention is more completely described with reference to the drawing, wherein.

DETAILED DESCRIPTION OF THE INVENTION

Figure 1:
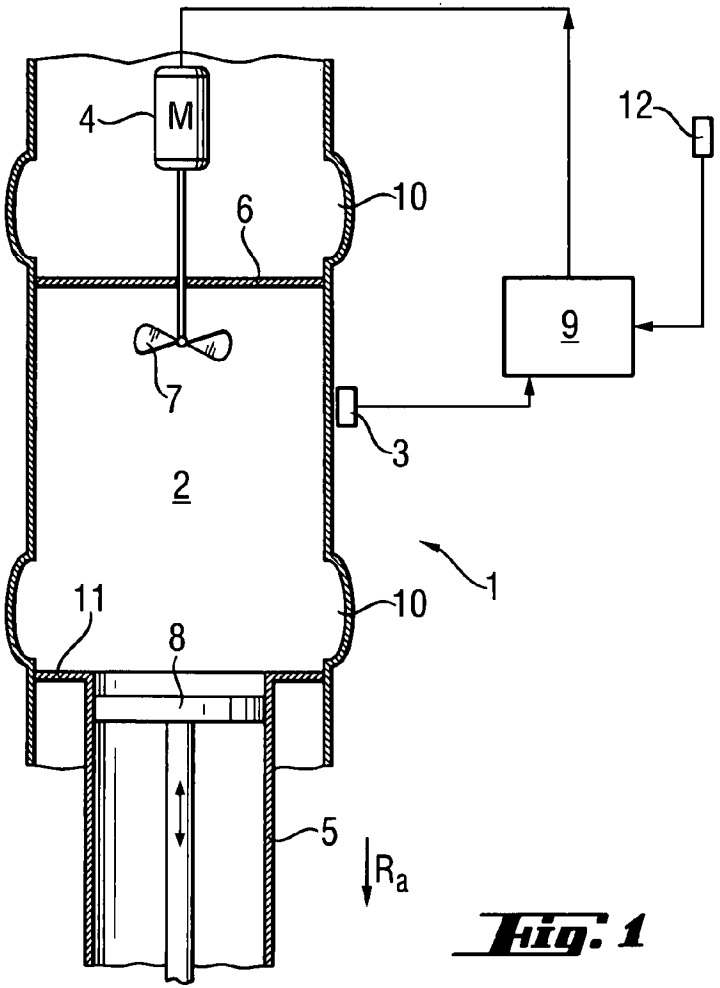
FIG. 1 shows a sectional view of a combustion driven working tool with a fan in a closed combustion chamber, in accordance with the invention.

FIG. 1 shows a sectional view of a combustion driven working tool 1 having a combustion chamber 2. A mixture of fuel gases ready in the combustion chamber 2 is ignited by an ignition device (not shown), whereby the piston 8 coupled to the combustion chamber and guided in the cylinder 5 is driven in a working direction Ra. A fan 7 is arranged in the combustion chamber 2 and serves to thoroughly mix the supplied mixture of gases and/or the supplied air and/or for cooling or flushing the combustion chamber. The fan 7 is driven by the motor 4. An upper combustion chamber wall 6 and a lower combustion chamber wall 11 are represented in a position, in which they approximately seal the outer walls of the combustion chamber 2, so that the combustion chamber is closed, for example before an ignition process.

A first temperature sensor is associated with the combustion chamber 2. This first temperature sensor 3 measures the combustion chamber temperature. A second temperature sensor 12 measures the external temperature. The two temperature values are sent to a control unit 9. The control unit 9 determines the required motor speed and the required fan cooling period depending on the measured combustion chamber temperature and/or the external temperature. Accordingly, in the control unit 9 both a simple assignment table can be used, in which a speed and a cooling period is assigned to each temperature value or for each temperature a calculation of the speed and/or the cooling period can be done. Using these values, the control unit 9 regulates the motor 4.

Figure 2:
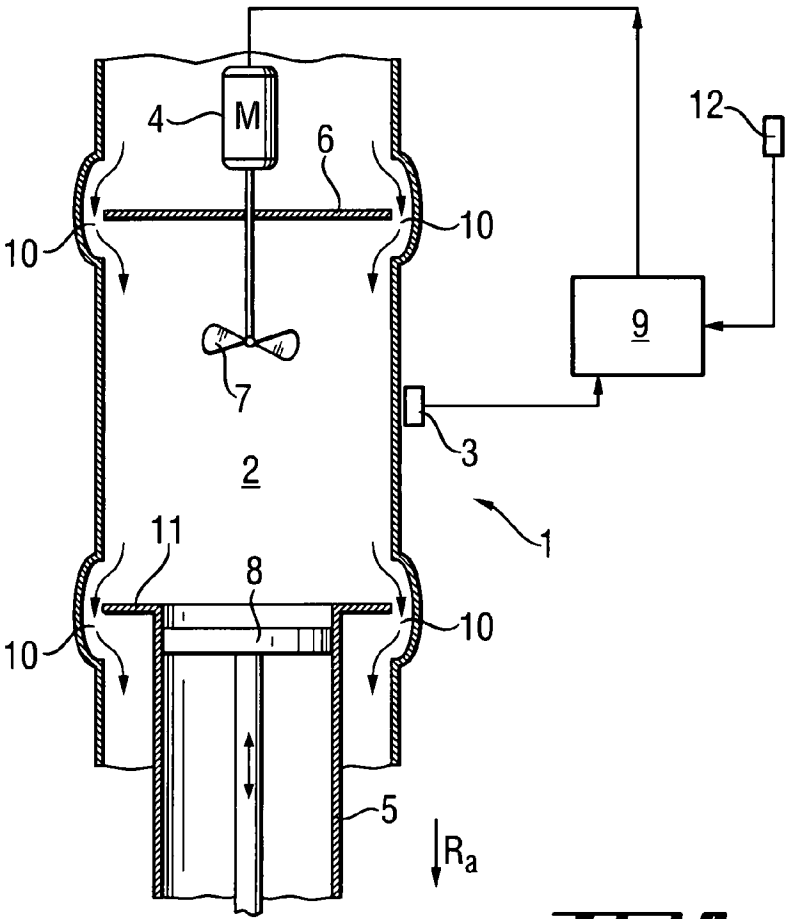
FIG. 2 shows a sectional view of a combustion driven working tool with a fan in an open combustion chamber, in accordance with the invention.

FIG. 2 shows a sectional view of the combustion driven working tool 1 according to FIG. 1 after the ignition process. In this case, the upper combustion chamber wall 6 and the lower combustion chamber wall 11 are displaced such that fresh air can be supplied through the ventilation systems 10 or residual gases can be discharged from the combustion chamber 2. The supply or discharge is thus supported by the fan 7, which is driven by the motor 4.

Figure 3:
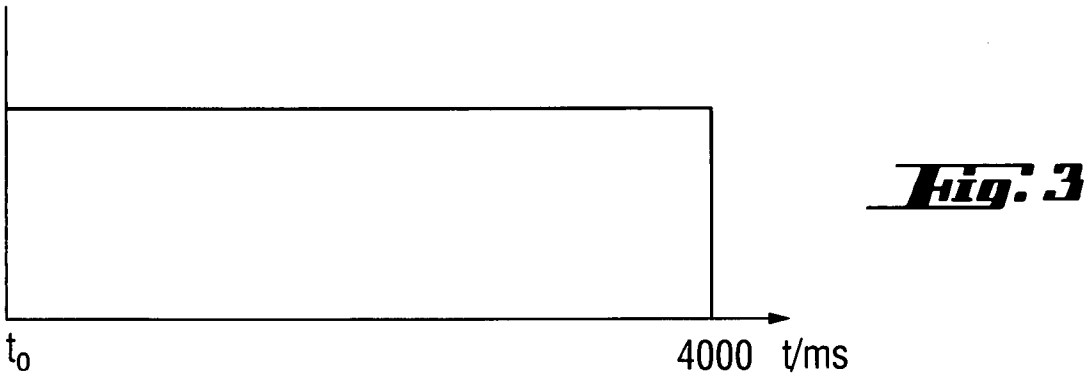
FIG. 3 shows a diagram for representing the contact time of the combustion driven working tool, in accordance with the invention.
Figure 4:
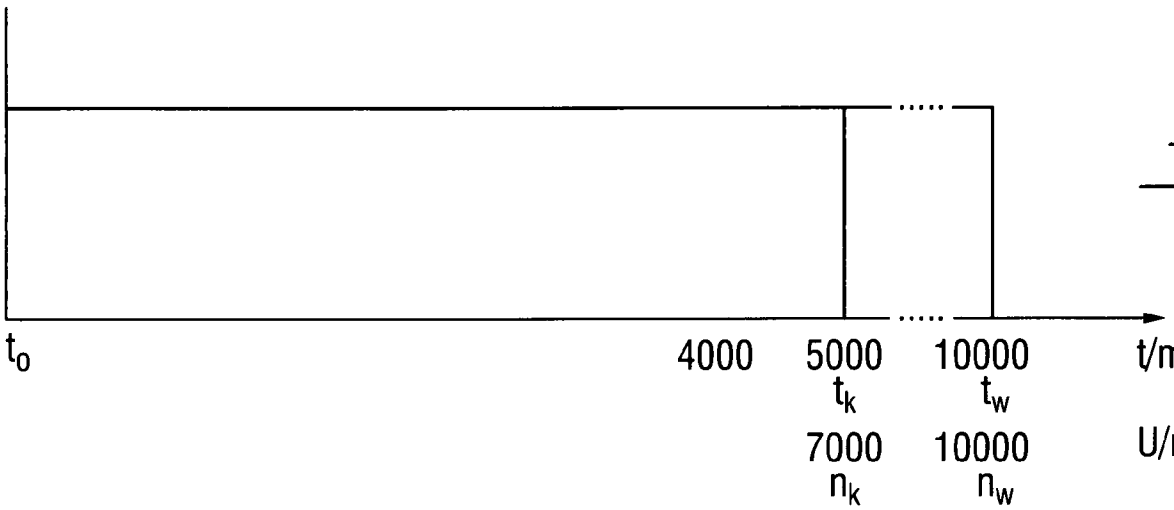
FIG. 4 shows a diagram for representing the running time or speed of the combustion driven working tool, in accordance with the invention.

FIG. 3 shows a diagram, in which the time is represented at which the working tool is applied. The working tool 1 is applied, for example, for 4,000 ms at time t0. During this time the ignition process and the setting operation are triggered. After the fastening element has been driven into the surface, the working tool 1 is placed again after approximately 4,000 ms. FIG. 4 is compared to FIG. 3, wherein the running time and the speed of the fan 7 are represented. In this instance, the fan 7 is activated at the start of the operation of applying the working tool. The time, in which the fan 7 runs, extends beyond the application time. The fan 7 could also be started after t0 and upon triggering the working tool.

In this simple embodiment, at a low combustion chamber temperature a first fan cooling time tk of 5,000 ms after t0 is selected, whereby the fan 7 is driven during this time at a lower initial speed nk of approximately 7,000 $min^{-1}$. This first cooling period tk and first speed produce a minimum ventilation of the combustion chamber 2 for the supply of required fresh air. At the same time, as much fresh air is supplied that the combustion chamber 2 is not excessively cooled, which would be disadvantageous for the formation of the gas mixture for the next ignition process.

If the first temperature sensor 3 detects a very high combustion chamber temperature, which is above a threshold value for the combustion chamber temperature, the control unit 9 will operate the fan 7 at a second higher speed nw and for a second cooling period tw, so that a greater air flow is made possible and the cooling of the combustion chamber 2 to a desired combustion chamber temperature will be achieved correspondingly faster. A high combustion chamber temperature is dependent on the setting frequency of the working tool since cooling is not possible in the very short intervals by virtue of the rapid setting of new fastening elements. The high combustion chamber temperature is favored by high external temperatures.

In another embodiment (not shown), the fan 7 is driven for at least the time, during which the ventilation systems 10 are opened, at a speed and time that can be set. This has the advantage that even at cold external temperatures a minimal, but for the flushing of the combustion chamber adequate ventilation can be achieved, whereby sufficient mixing of the gases with the fresh air for the next ignition process is provided without the combustion chamber cooling excessively. With the utilization of powder as the fuel for driving the piston, for example, only one ventilation is necessary after ignition, such that in this case no mixing is required before ignition and the fan is activated only after the ignition process, wherein even then the running time and the speed are temperature-dependent controlled.

What is claimed is:

1. A combustion driven working tool, comprising a combustion chamber (2); a cylinder (5) adjoining the combustion chamber (2); a piston (8) displaceable in the cylinder (5) in response to ignition of fuel in the combustion chamber (2); a fan (7) for ventilating the combustion chamber (2); and means for controlling at least one of running time and speed of the fan (7) dependent on the combustion chamber temperature and including a first temperature sensor (3) for measuring the combustion chamber temperature.

2. The combustion driven working tool of claim 1, wherein the controlling means further comprises a second temperature sensor for measuring an ambient temperature.

3. The combustion driven working tool of claim 1, wherein the controlling means comprises a controller unit (9) for regulating the at least one of running time and speed of the fan (7).

4. The combustion driven working tool of claim 1, wherein the fan (7) is located in the combustion chamber (2).

* * * * *